United States Patent [19]

Kindelspire

[11] 4,158,828

[45] Jun. 19, 1979

[54] RELAY DEVICE

[75] Inventor: Thomas J. Kindelspire, Morris, Ill.

[73] Assignee: General Electric Company, Fort Wayne, Ind.

[21] Appl. No.: 795,797

[22] Filed: May 11, 1977

[51] Int. Cl.[2] ..... H01H 9/02

[52] U.S. Cl. ..... 335/156; 335/202; 339/210 R

[58] Field of Search ..... 335/2, 156, 6, 202; 339/206 R, 206 P, 207 R, 208, 210 R

[56] References Cited

U.S. PATENT DOCUMENTS

| | | | |
|---|---|---|---|
| 3,130,284 | 4/1964 | Woods | 335/156 |
| 3,179,915 | 4/1965 | Klassen | 339/208 |
| 3,287,675 | 11/1966 | Woods | 335/202 |

*Primary Examiner*—George Harris

*Attorney, Agent, or Firm*—Joseph E. Papin

[57] ABSTRACT

A relay device adapted to be removably mounted in plug-on circuit relation with at least a pair of male terminals of an electrically energized apparatus. The relay device has receptacle means including a first portion with a pair of cavities for respectively receiving in predetermined seated position therein a pair of female terminals adapted for electrical contacting engagement with the male terminal pair. A cover portion is disposed in a predetermined assembled position on the first portion so as to generally enclose the chambers. The cover portion includes means for positioning engagement with the female terminal pair so as to maintain them generally against displacement from their predetermined seated positions in the cavities and a pair of openings communicating with the cavities and generally aligned with the female terminal pair for passing the male terminal pair into the cavities so as to be received in the electrical contacting engagement with the female terminal pairs. Means on the cover portion and the first portion are cooperatively associated for releasably maintaining the cover portion against displacement from its predetermined assembled position on the first portion.

17 Claims, 7 Drawing Figures

RELAY DEVICE

FIELD OF THE INVENTION

This invention relates in general to electrical devices and in particular to a relay device.

BACKGROUND OF THE INVENTION

In the past, relay devices have had a wide variety of applications with respect to various electrical energized apparatus. For example, an electric motor in a hermetic environment may, to avoid possible arcing within the hermetic environment, employ a relay device exteriorly of such environment with the relay device having normally open contacts in series with a start or auxiliary winding means of the electric motor and a relay coil in series with the run or main winding means of the electric motor. Thus, upon initial energization of the electric motor, a large current is drawn through through the main winding means causing the relay device to effect the closure of its contacts in order to energize the auxiliary winding means generally simultaneously with the energization of the main winding means of the electric motor. As the motor speed increases generally to a preselected value, the current draw of the main winding means is decreased, and the relay device drops out, i.e. effects the reopening of its contacts, thereby to disable or disconnect the auxiliary winding or disconnect it from circuit relation with the main winding means. Of course, the continued energization of the main winding means thereafter operates the electric motor generally at its preselected or synchronous speed.

One relay device well suited to this type arrangement is illustrated in Woods U.S. Pat. No. 3,130,284. This patented relay device includes an insulating housing containing movable contacts and an axially movable sleeve which is mounted within the housing so as to be movable between two positions to actuate the contacts. A reciprocable magnetic armature is slidably mounted on the sleeve, and an electrical coil is disposed on the housing for magnetically energizing the armature. When a sufficient current is drawn through the coil, the armature is magnetically attracted against a spring force to move the sleeve and drive the contacts to their closed position. When the current drawn through the coil drops below a specified or drop-out level, the magnetic field of the coil is correspondingly reduced, and the spring force overcomes the reduced magnetic attraction of the coil with respect to the armature drawing it against the contacts to effect the re-opening of the contacts. This relay device is mechanically mounted to a cooperating supporting structure by a generally U-shaped bracket having a pair of depending legs for grippingly receiving the relay device, and an integral base is formed between such leg to receive screws or the like which threadedly engage such cooperating supporting structure.

A plug-on relay device is disclosed in a later Lee O. Woods U.S. Pat. No. 3,287,675 in which female terminals are disposed in a portion of the relay device housing for receiving in electrical contacting engagement male terminals when the relay device is plugged into such male terminals. In this arrangement, the male terminals are predeterminately mounted so as to be connected in circuit relation with a winding circuit of an electric motor which may be disposed in a hermetic environment. Still another plug-on type relay device is disclosed in a copending Lee O. Woods U.S. patent application Ser. No. 809,054 filed June 22, 1977.

SUMMARY OF THE INVENTION

Among the several objects of the present invention may be noted the provision of an improved relay device; the provision of such relay device employing separate housing portions defining a terminal receptacle and which are assembled together by integral releasable securing means; the provision of such relay device in which female terminals are captured between the housing portions in their assembled positions; the provision of such relay device in which the female terminals are predeterminately seated by confronting parts of the housing portions in their assembled positions so as to at least limit displacement movement of the female terminals within the relay device; the provision of such relay device in which the housing portions define a smaller terminal receptacle compatable with reduced mounting space requirements of the modern electrically energized apparatus; and the provision of such relay device which is simplistic in design, easily assembled and economically manufactured. These as well as other objects and advantageous features of the present invention will be in part apparent and in part pointed out hereinafter.

In general, a relay device in one form of the invention is adapted to be removably mounted in plug-on circuit relation with a pair of male terminals of an electrically energized apparatus. The relay device has coil means adapted for electrical energization, and means is arranged in magnetic coupling relation with the coil means and operable generally for switching between circuit completing and interrupting positions. A pair of female terminals are connected in circuit relation with the coil means and the switching means and are adapted for receiving in electrical contacting engagement the male terminal pair. Means is provided for housing the coil means and the switching means and includes receptacle means for the removable mounting in the plug-on circuit relation with the male terminal pair. The receptacle means includes a first portion having a pair of cavities therein for respectively receiving in seated position the female terminal pair and a cover portion separable from the first portion and disposed in a predetermined assembled position therewith so as to generally capture the female terminal pair in the seated positions thereof in the cavity pair. A pair of openings is provided in the cover portion communicating with the cavity pair and generally aligned with the female terminal pair for accommodating the passage of the male terminal pair into the electrical contacting engagement with the female terminal pair upon the removable mounting of the receptacle means with the male terminal pair. Means respectively integral with the first portion are coopertively associated with each other for releasably maintaining the cover portion against displacement from its predetermined assembled position on the first portion.

BRIEF DESCRIPTION OF THE DRAWINGS

Corresponding reference characters indicate corresponding parts throughout the several views of the drawings.

The exemplifications set out herein illustrate a preferred embodiment of the invention in one form thereof, and such exemplifications are not to be construed as limiting the scope of the disclosure or the scope of the invention in any manner.

DETAILED DESCRIPTION OF THE PREFERRED EMBODIMENTS

Figure 7:
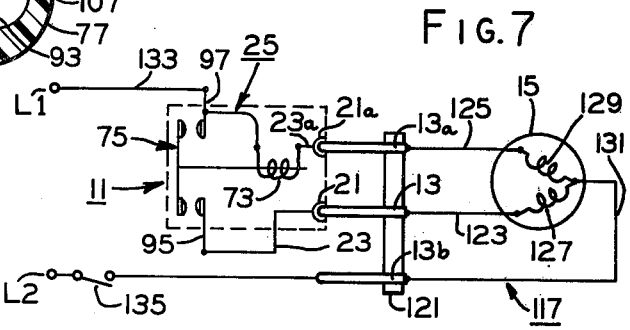
FIG. 7 is an exemplary schematic diagram of an electrical circuit in which the relay device of FIG. 1 may be utilized.
Figure 2:
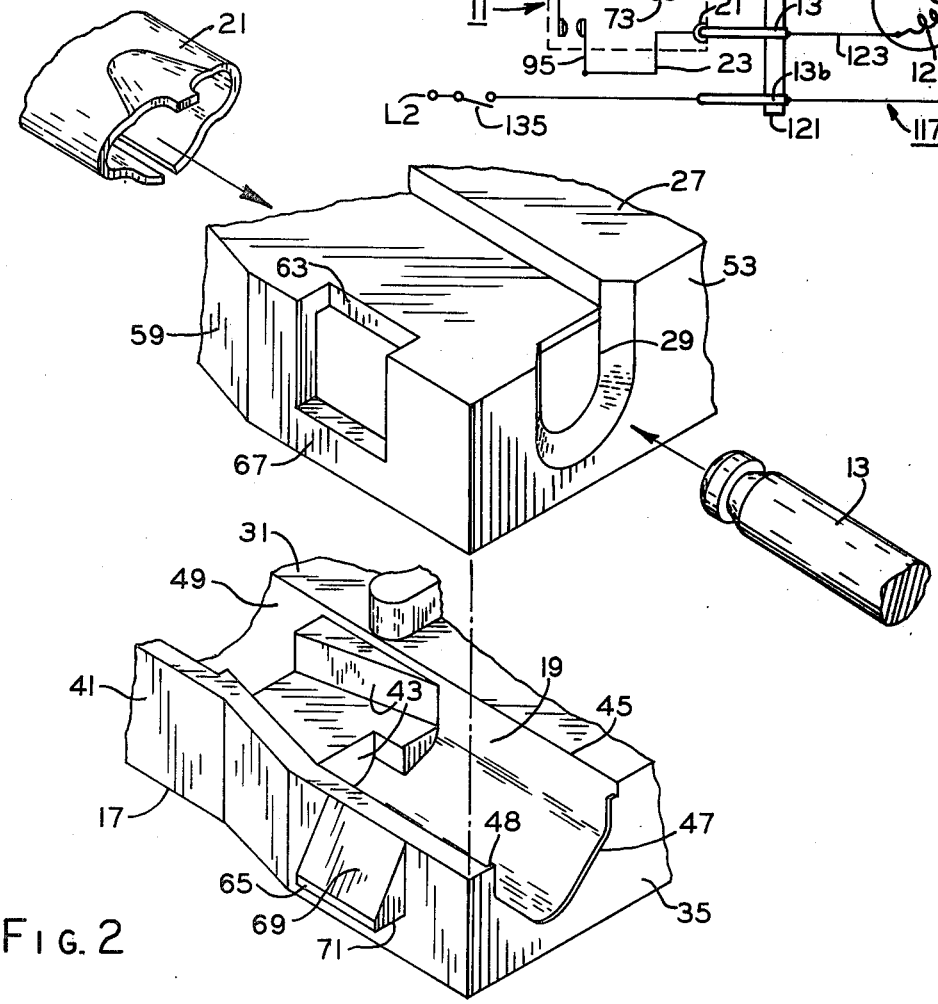
FIG. 2 is a partial exploded perspective view of a receptacle means of the relay device of FIG. 1 teaching principles which may be utilized in a method of assembling a relay device.
Figure 3:
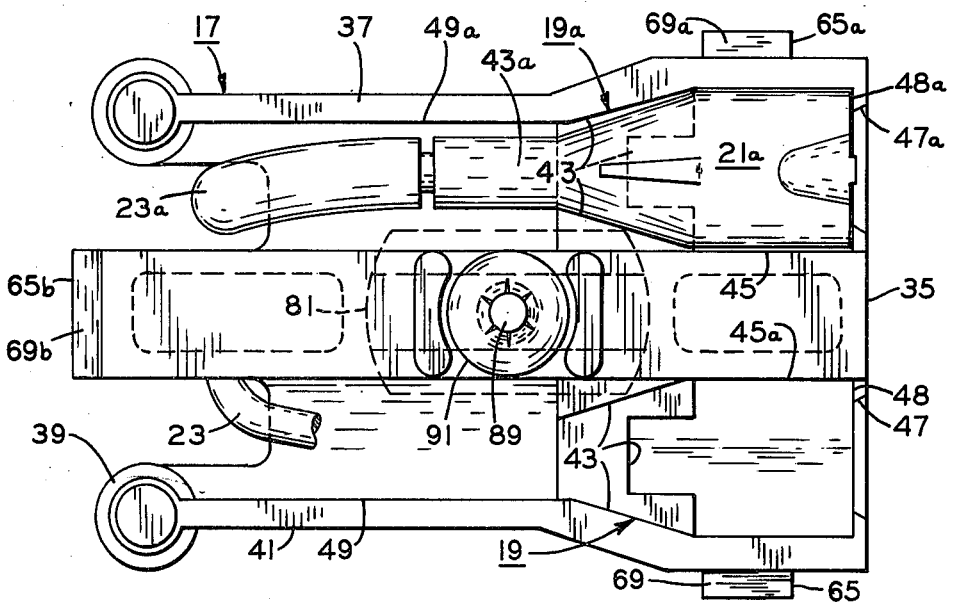
FIG. 3 is a partial top elevational view of the relay device of FIG. 1 illustrating the receptacle means with a cover portion thereof removed to illustrate the seating of female terminals within cavities provided therefor in the receptacle means.
Figure 4:
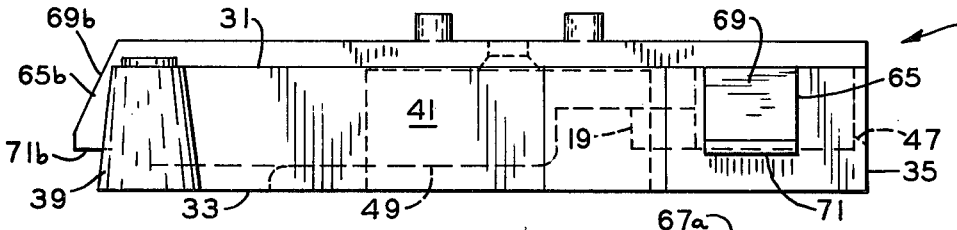
FIG. 4 is a side elevation of the portion of the receptacle means shown in FIG. 3.
Figure 5:
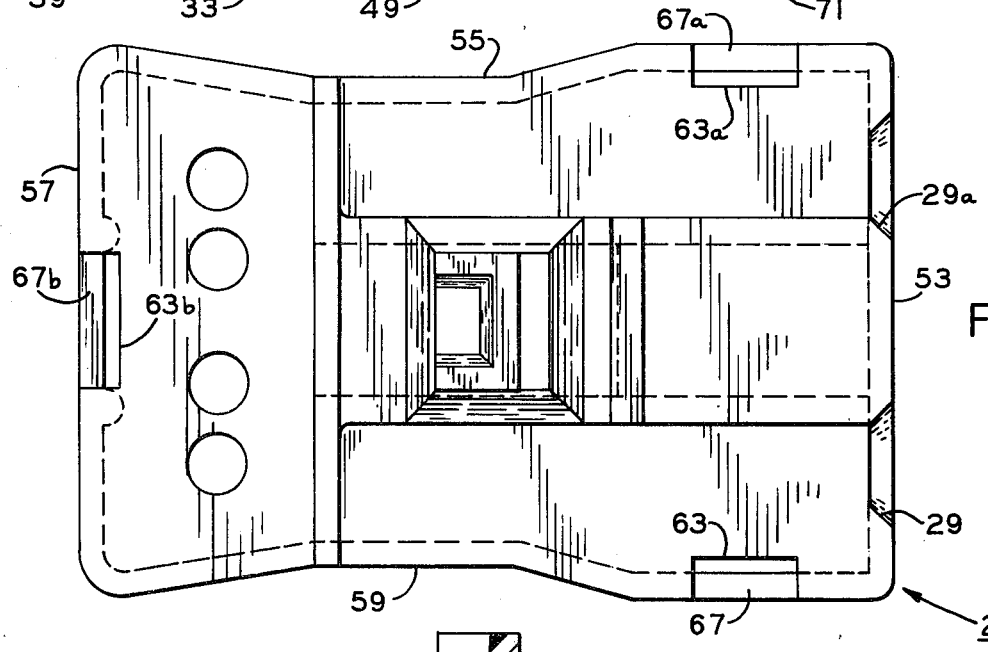
FIG. 5 is a plan view of the cover portion of the receptacle means.
Figure 6:
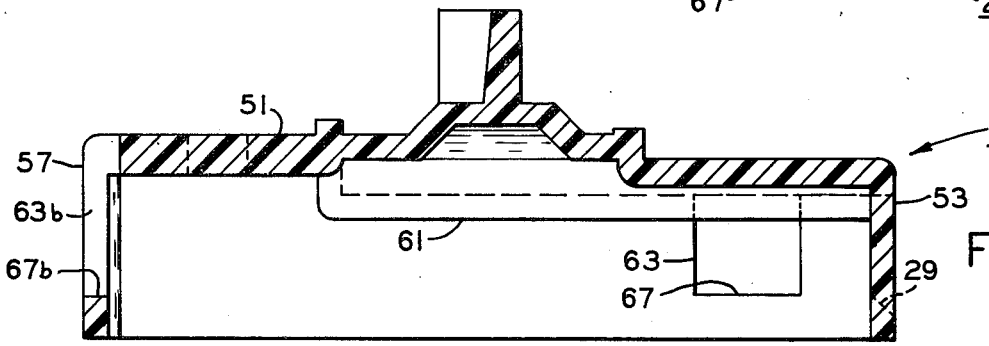
FIG. 6 is a side elevational view of the cover portion of FIG. 5.

Referring now to the drawings in general, a method is provided for assembling a relay device 11 adapted to be releasably or removably mounted in plug-on relation with male terminals 13, 13*a* of an electrically energized apparatus, such as a prime mover or electric motor 15 for instance (FIG. 7). Relay device 11 has a housing or flange housing portion 17 with a pair of cavities, such as chambers or pockets 19, 19*a*, therein adapted to seat a pair of female terminals or terminal means 21, 21*a* electrically connected to electrical leads or lead parts 23, 23*a* in circuit means 25 of the relay device (FIGS. 2, 3 and 7). In this assembling method, female terminals 21, 21*a* are arranged, placed or otherwise disposed with respect to cavities 19, 19*a* so that the female terminals may be seated therein (FIGS. 2 and 3). A cover or cover or housing portion 27 is releasably secured to flange 17 in a predetermined assembled position to capture female terminals 21, 21*a* in cavities 19, 19*a*, and a pair of means, such as openings 29, 29*a* or the like for instance in the cover are disposed, positioned or otherwise located with respect to the cavities and the female terminals for accommodating the passage through the openings of male terminals 13, 13*a* into electrical contacting engagement with the female terminals when relay device 11 is removably mounted in the plug-on relation with the male terminals (FIGS. 2, 5 and 7).

More particularly and with specific reference to FIGs. 2–6, flange 17 and cover 27 are respectively molded or otherwise formed from a material having good electrical insulating characteristics, such as for instance a plastic or the like, and which is yieldable or resilient at least to a preselected degree. However, it is contemplated that only one of flange 17 and cover 27 may be formed of the aforementioned yieldable or deformable material within the scope of the invention so as to meet the objects and advantageous features thereof. Flange 17 has a pair of generally opposite or upper and lower surfaces 31, 33 interconnected or intersecting between a plurality of side surfaces 35, 37, 39, 41, and cavities 19, 19*a* are provided in the flange generally in spaced apart side-by-side relation intersecting with upper surface 31 and side surface 35. A pair of means, such as seats or abutments 43, 43*a*, for seating or seating engagement with female terminals 21, 21*a* are provided in cavities 19, 19*a*, and a pair of slots or groove portions 45, 45*a* extend from the seats in one direction toward side surface 35 terminating in a pair of apertures 47, 47*a* which intersect with the side surface. Another pair of means, such as seats or shoulders 48, 48*a*, for seating engagement with female terminals 21, 21*a* are also provided in cavities 19, 19*a* extending between slots 45, 45*a* and apertures 47, 47*a*. Thus, cavities 19, 19*a* comprise seats 43, 43*a*, slots 45, 45*a*, apertures 47, 47*a* and shoulders 48, 48*a* with the seats, slots and shoulders adapted to engage or seat confronting parts of female terminals 21, 21*a* respectively. Lead guides, such as passage means or passages 49, 49*a*, which receive lead parts 23, 23*a* electrically connected to female terminals 21, 21*a*, are associated or connected with cavities 19, 19*a* extending therefrom in a direction generally opposite to that of slots 45, 45*a*, i.e. toward side surface 39, and the passage means intersect with upper and lower surfaces 31, 33 and side surface 39. Cover 27 has a plurality of wall means, such as a cover wall 51 interconnected or intersecting between a plurality of sidewalls 53, 55, 57, 59, and openings 29, 29*a* are predeterminately positioned through sidewall 53 so as to generally align with female terminals 21, 21*a* seated in cavities 19, 19*a* and apertures 47, 47*a* thereof when the cover and flanges are in their predetermined assembled positions.

With female terminals 21, 21*a* and lead parts 23, 23*a* respectively positioned in cavities 19, 19*a* and passage means 49, 49*a* as previously mentioned, sidewalls 53–59 of cover 27 may be located or generally aligned so as to at least in part overlay in opposed confronting relation side surfaces 35–41 of flange 17. Of course, with sidewalls 53–59 so located with respect to side surfaces 35–41, cover wall 51 is spaced from upper surface 31 of flange 17 generally in overlaying relation therewith. At least one of flange 17 and cover 27 is thereafter moved with respect to the other thereof into their predetermined assembled position so as to dispose cover wall 51 at least closely adjacent upper surface 31 of the flange thereby to effect the closure of cavities 19, 19*a* and passage means 49, 49*a* capturing or enclosing female terminals 21, 21*a* and lead parts 23, 23*a* therein, respectively. Upon such movement of flange 17 and cover 27 to the predetermined assembled position thereof, engagement means, such as abutments 61, 61*a*, on cover wall 51 may be disposed in abutting or locating engagement with confronting parts of female terminals 21, 21*a* so as to at least limit displacement movement of the female terminals with respect to seats 43, 43*a* and shoulders 48, 48*a* in cavities 19, 19*a*. Thus, cavities 19, 19*a* and abutments 61, 61*a* respectively provide a pair of means defined between flange 17 and cover 27 for containing female terminals 21, 21*a* in the captured positions thereof. Further, it may be noted that the displacement movement in cavities 19, 19*a* of female terminals 21, 21*a* is also at least limited by the engagement of the female terminals between their seats 43, 43*a* and shoulders 48, 48*a* of the cavities.

As flange 17 and cover 27 are being assembled in their predetermined assembled position, a plurality of recess or latching means 63, 63*a*, 63*b* provided in sidewalls 59, 55, 57 of the cover are received over a plurality of detent or latching means 65, 65*a*, 65*b* integrally provided on side surfaces 41, 37, 39 of the flange so as to be releasably engaged or secured therewith, and with the detent means and recess means so cooperatively associated with each other, the cover and flange are releasably maintained against displacement from their predetermined assembled position. In other words when flange 17 and cover 27 are moved to their predetermined assembled positions, a part of a plurality of leading or distal edges or edge portions 67, 67a, 67b of sidewalls 55, 59, 57 adjacent recess means 63, 63a, 63b are engaged with a plurality of sloped surfaces 69, 69a, 69b of detent means 65, 65a, and in response to the wedging action of this engagement, sidewalls 55, 59, 57 yield or are spread slightly apart to accommodate the passage of the sidewall edges over the sloped surfaces. Of course, when sidewall edges 67, 67a, 67b pass over sloped surfaces 69, 69a, 69b, the resiliency of sidewalls 55, 59, 57 cause them to regain their original shape generally snapping the edge portions 67, 67a, 67b into releasable holding or securing engagement with a plurality of lower holding or latching shoulders or catches 71, 71a, 71b on detent means 65, 65a, 65b so that the detent means protrude into the recess means. Thus, recess means 63, 63a, 63b and detent means 65, 65a, 65b comprise means for releasable engagement with each other so as to maintain flange 17 and cover 27 in their predetermined assembled position. While recess means 63, 63a, 63b and detent means 65, 65a, 65b are illustrated herein as being integral with cover 27 and flange 17, it is contemplated that the recess means might be integral with the flange with the detent means being integral with the cover or that both the cover and the flange may be provided with each of the recess means and the detent means within the scope of the invention so as to meet the objects and advantageous features thereof. Further, while three cooperatively associated recess means 63, 63a, 63b and detent means 65, 65a, 65b are illustrated herein for purposes of disclosure, it is also contemplated that a greater or lesser number of such cooperating associated recess means and detent means may be utilized within the scope of the invention so as to meet the objects and advantageous features thereof.

Figure 1:
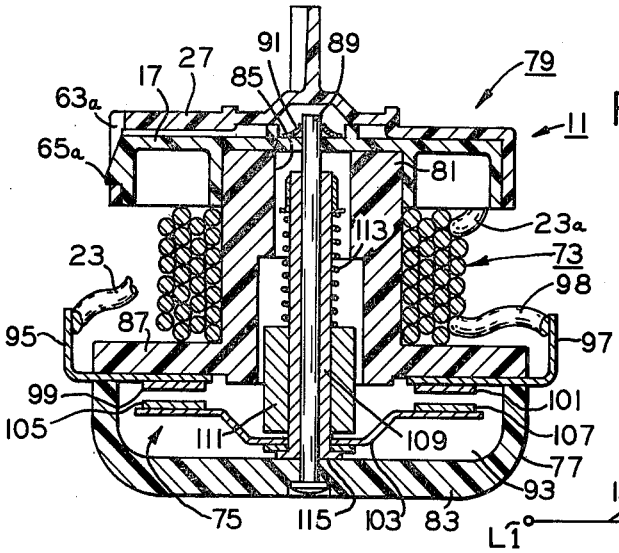
FIG. 1 is a sectional view illustrating a relay device in one form of the invention in cross-section.

Referring again in general to the drawings and recapitulating at least in part with respect to the foregoing, relay device 11 in one form of the invention is adapted to be removably mounted in plug-on circuit relation with male terminal pair 13, 13a of electric motor 15 (FIG. 7). Relay device 11 is provided with coil means 73 adapted for electrical energization, and means, indicated generally at 75, is arranged in magnetic coupling relation with the coil means and operable generally for switching between circuit completing and interrupting positions (FIG. 1). Female terminals 21, 21a are connected in circuit relation with coil means 73 and switching means 75, and the female terminals are adapted for receiving in electrical contacting engagement male terminals 13, 13a (FIGS. 1, 2 and 7). Means, indicated generally at 77, is provided for housing coil means 73 and switching means 75, and the housing means includes a plug-on terminal receptacle or receptacle means 79 for the removable mounting in the plug-on relation with male terminals 13, 13a with the receptacle means generally being comprised by flange 17 and cover 27, (FIG. 1). Flange 17 has cavities 19, 19a for respectively receiving in seated positions therein female terminals 21, 21a, and cover 27 is separable from the flange and disposed in the predetermined assembled position therewith so as to capture the female terminals generally in the seated positions thereof in the cavities (FIGS. 1–3 and 5). Openings 29, 29a in cover 27 communicate with cavities 19, 19a and are generally aligned with the female terminals captured in the seated positions thereof in the cavities for accommodating the passage of male terminals 13, 13a into the electrical contacting engagement with the female terminals upon the removable mounting of receptacle means with the male terminal means (FIGS. 2, 3, 5 and 7). A plurality of means, such as recess means 63, 63a, 63b and detent means 65, 65a, 65b are respectively integral with cover 27 and flange 17 and are cooperatively associated with each other for releasably maintaining the cover against displacement from its predetermined assembled position on the flange (FIGS. 2, 3 and 5).

More particularly and with specific reference to FIGS. 1, 3 and 5, housing means 77 has a plurality of housing portions including flange 17, cover 27, a bobbin 81 and a closure member 83, and the bobbin and closure member may also be molded or otherwise formed from a suitable dielectric material. Bobbin 81 has a bore 85 extending between the opposite ends thereof, and an integral base 87 extends generally radially of the bobbin adjacent one of the opposite ends thereof. A headed pin 89 extending through bobbin bore 85, closure member 83 and flange 17 retains the closure member seated on bobbin base 87 and retains the flange seated on the other end of bobbin 81, and a jam nut or washer 91 or the like is fixedly connected between the pin and the flange thereby to retain the flange and closure member against displacement from the bobbin. Thus, flange 17, bobbin 81 and closure 83 enclose or define a switching means operating chamber 93 which includes bobbin bore 85, and a pair of terminals 95, 97 mounted between bobbin base 87 and closure member 83 have ends extending interiorly and exteriorly of the switch means chamber.

Coil means or relay coil 73 comprises a plurality of turns of dielectrically coated wire wound about bobbin 81 between base 87 thereof and flange 17, and one end or lead part 23a of the turn plurality is connected by suitable means, such as soldering or crimping for instance, with female terminal 21a while the other end or lead part 98 of the turn plurality is connected by suitable means, such as soldering for instance, to the exterior end of terminal 97. Lead 23 which is connected by suitable means, such as soldering or crimping or the like to female terminal 21, as previously mentioned, also has an end extending exteriorly of receptacle means 79 and connected by suitable means, such as soldering or the like, to the exterior end of terminal 95.

Switching means 75 comprises a pair of contacts 99, 101 mounted to the interior end of terminals 95, 97 in chamber 93, and a bridge 103 carries another pair of contacts 105, 107 adapted for making and breaking engagement with contacts 99, 101. Bridge 103 is carried adjacent the lower end of a sleeve 109 slidably movable on pin 89, and an armature means 111 is slidably received about the sleeve and predeterminately positioned so as to be magnetically coupled with coil means 73 upon the energization thereof. Resilient means, such as a coil spring 113, is caged between armature means 111 and the upper end of sleeve 109. Thus in the at-rest position of switching means 75, the weight of armature means 111 acting on bridge 103 urges it into abutment with a hub 115 on the lower end of sleeve 109 and also urges the hub into engagement with closure member 83.

After the component parts of relay device 11 are assembled together as described above, lead parts 23, 23a may be led into or laid in passage means 49, 49a of flange 17 so that female terminals 21, 21a are disposed in cavities 19, 19a in seating engagement therein between seats 43, 43a and shoulders 48, 48a, as shown in FIG. 3. With female terminals 21, 21a and leads 23, 23a so located in flange 17, cover 27 may be disposed generally about the flange in the assembled positions thereof wherein recess means 63, 63*a*, 63*b* of the cover and detent means 65, 65*a*, 65*b* of the flange are releasably engaged so as to maintain the cover and the flange in their predetermined assembled positions, as previously described hereinabove.

Thus, when cover 27 is releasably secured to flange 17 to complete the assembly of relay device 11, receptacle means 79 may be removably mounted in plug-on circuit relation with male terminals 13, 13*a*, as illustrated in FIGS. 2 and 7, by passing openings 29, 29*a* in the receptacle means over the male terminals and inserting female terminals 21, 21*a* captured within cavities 19, 19*a* of the receptacle means into electrical contacting engagement with the male terminals.

Referring now to an exemplary circuit 117 shown in FIG. 7, male terminals 13, 13*a* and a third male terminal 13*b* may be mounted in a Fusite plug 121, if desired, on apparatus, such as a compressor for instance (not shown) having an hermetic environment in which electric motor 15 operates. Of course, male terminals 13, 13*a*, 13*b* may also be mounted in various other manners well known to the art on supporting structure (not shown) which may be associated with electric motor 15 within the scope of the invention so as to meet the objects and advantageous features thereof. Male terminals 13, 13*a* are respectively connected by leads 123, 125 with auxiliary or start winding means 127 and main or run winding means 129 of electric motor 15, and a return lead 131 interconnects the auxiliary and main winding means through male terminal 13*b* to a power terminal L2 which represents one side of a power source L1, L2. To complete the exemplary circuit, another lead 133 is connected between power terminal L1 and the external end of terminal 97 in relay device 11, and an on-off type switch 135 may be interconnected in lead 131 (or lead 133 if desired) for controlling the energization of electric motor 15 across power source L1, L2.

In the operation of relay device 11 in circuit 117 with the components thereof in their at-rest positions as shown in the drawings and described hereinabove, an operator may close on-off switch 135 to effect the energization of electric motor 15 across power source L1, L2. With on-off switch 135 closed, current may flow from power terminal L1 through lead 133, relay device terminal 97, coil means 73, female terminal 21*a*, male terminal 13*a*, lead 125 to main winding means 129 of electric motor 15 and therefrom through return lead 131, male terminal 13*b* and closed switch 135 to power terminal L2. Of course, upon such initial energization of electric motor 15, there is a rather heavy current draw by its main winding means, and coil means 73 of relay device is responsive to such current draw to produce a magnetic field coupling with armature means 111 causing it to throw or rise (as best seen in FIG. 1) upwardly against the compressive force of spring 113. Of course, the force exerted by the rising movement of armature means 111 against spring 113 is transmitted therethrough to sleeve 109, and the sleeve rises on pin 89 generally conjointly with the rise of the armature means. In this manner, bridge 103 is moved upwardly with sleeve 109 until contacts 105, 107 on the bridge are moved into a circuit completing position in making engagement with contacts 99, 101. When contacts 105, 107 are made with contacts 99, 101, current flows from relay device terminal 97 through bridge 103 to terminal 95 and therefrom through lead 23, female terminal 21, male terminal 13 and lead 123 to effect the energization of excitation of auxiliary winding means 127 generally simultaneously with the above described excitation of main winding means 129. As electric motor 15 is energized by both auxiliary and main winding means 127, 129 generally to a preselected or synchronous speed, the current draw is appreciably reduced effecting a corresponding reduction of the intensity of the magnetic field produced by coil means 73 in response to the reduced current draw. Therefore, when the current draw attains a preselected low or drop-out value for relay device 11, the magnetic coupling between coil means 73 and armature means 111 of the relay device is insufficient to hold the armature means against the compressive force of spring 113 acting thereon. Thus, the compressive force of spring 113 drives armature means 111 in a downward direction (as best seen in FIG. 1) so as to strike a hammer-like blow to bridge 103 causing it to move contacts 105, 107 from contacts 99, 101 in a very positive manner, and thereafter spring 113 drives the armature means, the bridge and sleeve 109 toward their at-rest or circuit interrupting positions, as previously described. Of course, upon the breaking of contacts 105, 107 from contacts 99, 101, circuit means 25 of relay device 11 is opened therethrough so as to effect the deexcitation of auxiliary winding means 127 of electric motor 15, and the electric motor may be thereafter energized generally at its synchronous speed in response to the excitation of main winding means 127 thereof. If a more detailed description of the operation of relay device 11 is desired reference may be had to the Lee O. Woods U.S. Pat. No. 3,130,284.

From the foregoing, it is now apparent that a novel relay device 11 and has been presented meeting the objects and advantageous features set out hereinabove, as well as others, and that modifications as to the precise configurations, shapes, details and connections of the relay device may be made by those having ordinary skill in the art without departing from the spirit of the invention or the scope thereof as set out by the claims which follow.

What I claim as new and desire to secure by Letters Patent of the United States is:

1. A relay device adapted to be removably mounted in plug-on circuit relation with a pair of male terminals of an electrically energized apparatus, the relay device comprising:

a housing having receptacle means adapted for the releasable mounting in the plug-on circuit relation with the male terminals;

coil means arranged with said housing and adapted for electrical energization;

switch means in said housing including a first pair of contact means, a second pair of contact means movable between making and breaking positions with respect to said first contact means pair, and armature means disposed in magnetic coupling relation with said coil means and associated with said second contact means pair for moving them from one of the making and breaking positions to the other thereof upon the energization of said coil means;

a pair of female terminals for receiving in electrical contacting engagement the male terminals;

a first lead associated with said coil means and electrically connected with one of said female terminals;

a second lead electrically connected between the other of said female terminals and one of said contact means of said first contact means pair;

said receptacle means including a first portion having a pair of opposite surfaces interconnected between a plurality of side surfaces, a pair of cavities in said first portion intersecting with one of said opposite surfaces and one of said side surfaces of said side surface plurality and in which said female terminal pairs are predeterminately positioned in seating engagement, respectively, a pair of passage means in said first portion and associated with said cavity pair for receiving a part of said first and second leads, respectively, said passage means pairs respectively intersecting with another of said side surfaces of said side surface plurality and at least one of said one opposite surfaces and the other of said opposite surfaces, said receptacle means also including a cover portion arranged in a predetermined assembled position on said first portion and having a plurality of wall means including a cover wall interconnected between a plurality of sidewalls depending therefrom, said cover wall being disposed generally in overlaying relation with said one opposite surface and at least some of said sidewalls of said sidewall plurality being disposed at least in part in opposed confronting relation with at least some of said side surfaces of said side surface plurality so as to generally capture said female terminal pair in said cavity pair with said at least part of said first and second leads enclosed within said passage means pair when said cover portion is in its predetermined assembled position on said first portion, means on at least said cover wall for abutting engagement with said female terminal pair to at least limit displacement movement of said female terminal pair from the seating engagement thereof in said cavity pair, respectively, a pair of openings in said one sidewall of said sidewall plurality communicating with said cavity pair for the passage of the male terminals into the electrical contacting engagement with said female terminal pair upon the removable mounting of the receptacle means in the plug-on circuit relation with the male terminals, and at least two confronting sidewalls and side surfaces of said sidewall and side surface pluralities respectively including integral means cooperatively associated for releasably maintaining said cover portion against displacement from its predetermined assembled portion on said first portion.

2. A relay device adapted to be removably mounted in plug-on circuit relation with a pair of male terminals of an electrically energized apparatus, the relay device comprising:

coil means adapted for electrical energization;

means arranged in magnetic coupling relation with said coil means and operable generally for switching between circuit completing and interrupting positions;

a pair of female terminals connected in circuit relation with said coil means and said switching means and adapted for receiving in electrical contacting engagement the male terminal pair, respectively; and means for housing said coil means and said switching means and including receptacle means for the removable mounting in the plug-on circuit relation with the male terminal pair, said receptacle means including a first portion having a pair of cavities therein for respectively receiving in seated positions therein said female terminal pair, and a cover portion separable from said first portion and disposed in a predetermined assembled position therewith so as to capture said female terminal pair generally in the seated positions thereof in said cavity pair, a pair of openings in said cover portion communicating with said cavity pair and generally aligned with said female terminal pair captured in the seated positions thereof in the cavity pair for accommodating the passage of the male terminal pair into the electrical contacting engagement with said female terminal pair upon the removable mounting of said receptacle means with the male terminal pair, and a plurality of pairs of means respectively integral with said first portion and said cover portion and cooperatively associated with each other for releasably maintaining said cover portion against displacement from its predetermined assembled position on said first portion.

3. A relay device as set forth in claim 2 wherein said first portion includes a first surface interconnected between a plurality of side surfaces with said cavity pair intersecting said first surface and one of said side surfaces of said side surface plurality, said cover portion being disposed in overlaying relation with said first surface and said side surfaces.

4. A relay device as set forth in claim 2 wherein said cover portion includes a cover wall interconnected between a plurality of sidewalls depending therefrom, said cover wall and said sidewalls of said sidewall plurality being disposed at least adjacent said first portion in overlaying relation with the cavity pair thereof, and said opening pair extending through one of said sidewalls.

5. A relay device as set forth in claim 2 wherein said first portion includes a first surface interconnected between a plurality of side surfaces, said cavity pair respectively intersecting said first surface and one of said side surfaces of said side surface plurality, said cover portion further including a cover wall interconnected between a plurality of sidewalls depending therefrom, said cover wall being disposed in overlaying relation with said first surface and at least some of said sidewalls of said sidewall plurality being disposed at least in part in opposed confronting relation with at least some of said side surfaces of said side surface plurality to effect the capturing of the female terminal pair in the cavity pair, said opening pair extending through one of said sidewalls of said sidewall plurality.

6. A relay device as set forth in claim 5 wherein at least two confronting sidewalls and side surfaces of said sidewall and side surface pluralities include said releasably retaining means, respectively.

7. A relay device as set forth in claim 2 wherein said releasably retaining means comprises at least a pair of latching means on each of said cover portion and said first portion for latching engagement.

8. A relay device as set forth in claim 2 wherein said releasably retaining means comprises at least one latching recess means in one of said cover portion and said first portion, and at least one latching detent means on the other of said cover portion and said first portion for latching engagement with said at least one latching recess means when said cover portion is in its predetermined assembled position on said first portion.

9. A relay device as set forth in claim 2 wherein said cover portion includes a pair of means for positioning engagement with confronting parts of said female terminal pairs so as to retain them against displacement movement from said cavity pair.

10. In a relay device having a housing including receptacle means adapted to be removably mounted in plug-on circuit relation with a pair of male terminals of an electrically energized apparatus with the receptacle means having a pair of cavities for receiving a pair of female terminals therein and a pair of openings communicating with the cavity pair for passing the male terminal pair therethrough generally toward the cavity pair into electrical contacting engagement with the female terminal pair; the improvement wherein the receptacle means comprises a first portion having a plurality of surface means including a first surface interconnected between a plurality of side surfaces, the cavity pair intersecting with said first surface and one of said side surfaces of said side surface plurality and defining means on said first portion engaged with the female terminal pair for seating them within the cavity pair, respectively, a cover portion arranged in a predetermined assembled position on said first portion and having a plurality of wall means including a cover wall interconnected between a plurality of sidewalls depending therefrom, said cover wall being disposed in overlaying relation with said first surface and at least some of said sidewalls of said sidewall plurality being disposed generally in opposed confronting relation with at least some of said side surfaces of said side surface plurality so as to capture the female terminal pair in the cavity pair when said cover portion is in its predetermined assembled position of said first portion, said opening pair extending through one of said sidewalls of said sidewall plurality so as to effect the communication with the cavity pair and the passage of the male terminal pair into the electrical contacting engagement with the female terminal pair upon the removable mounting of the receptacle means in the plug-on circuit relation with the male terminal pair, and at least two confronting sidewalls and side surfaces of said sidewall and side surface pluralities respectively having means cooperatively associated with each other for releasably maintaining said cover portion against displacement from its predetermined assembled position on said first portion.

11. The relay device as set forth in claim 10 further comprising means on said cover portion for abutment with confronting parts of the female terminal pair so as to at least limit displacement movement of the female terminal pair with respect to said seating means therefor in the cavity pair, respectively.

12. The relay device as set forth in claim 10 wherein said releasably maintaining means comprises recess means on each of one of the at least two confronting sidewalls and side surfaces, and detent means on each of the other of the at least two confronting sidewalls and side surfaces and disposed in latching engagement with said recess means when said cover portion is in its predetermined assembled position on said first portion, respectively.

13. The relay device as set forth in claim 10 wherein the female terminal pair are electrically connected with a pair of electrical leads, and further comprising a pair of passage means in said first portion and associated with the cavity pair for receiving a part of the lead pair, said passage means pair intersecting with another of said side surfaces of said side surface plurality and with said first surface, respectively, and said cover wall at least in part enclosing the part of said lead pair within the passage means pair, respectively.

14. A relay device adapted to be removably mounted in plug-on circuit relation with male terminals of electrically energized apparatus, the relay device comprising a housing having a plug-on terminal receptacle, said terminal receptacle including a first portion forming an integral part of said housing, and a second portion releasably attachable to said first portion; said first portion including at least a pair of recessed female terminal seats, a pair of lead guides extending from said seats in a first direction, and a pair of slots extending from said seat pair in another direction; said second portion having a pair of male terminal receiving openings alignable with said slot pair of said first portion when the second portion is attached to said first portion, and at least one latching means integral with one of said first and second portions and engageable with at least another latching means integral with the other of said first and second portions for holding said first and second portions together, said at least one and other latching means being engageable and disengageable by resilient deformation of at least a part of one of said one and other of said first and second portions.

15. A relay device as set forth in claim 14 further comprising a pair of female terminals disposed in said seats in engagement with confronting parts of said second portion and extending generally about said opening pair.

16. A relay device as set forth in claim 14 further comprising a pair of relay leads electrically connected with said female terminal pair and disposed in part in said lead guide pair, respectively.

17. A relay as set forth in claim 14 wherein one of said one and another latching means comprises an integral lug, said lug including a sloped surface terminating in a catching surface for engaging the other of said one and other latching means so as to hold said first and second portions firmly together.

* * * * *

UNITED STATES PATENT AND TRADEMARK OFFICE

CERTIFICATE OF CORRECTION

PATENT NO. : 4,158,828

DATED : June 19, 1979

INVENTOR(S) : T. J. Kindelspire

It is certified that error appears in the above-identified patent and that said Letters Patent are hereby corrected as shown below:

Col. 3, line 43, insert --,-- after "instance".
Col. 8, line 35, after device 11 delete "and".
Col. 12, line 15, delete "said" and insert --the--; same line delete "the" (second occurrence) and insert --said--.

Signed and Sealed this

*Eleventh* Day of *December 1979*

[SEAL]

*Attest:*

SIDNEY A. DIAMOND

*Attesting Officer*

*Commissioner of Patents and Trademarks*